US010160037B2

(12) United States Patent
Nomura et al.

(10) Patent No.: US 10,160,037 B2
(45) Date of Patent: Dec. 25, 2018

(54) RARE EARTH MAGNET AND ITS PREPARATION

(71) Applicant: SHIN-ETSU CHEMICAL CO., LTD., Tokyo (JP)

(72) Inventors: Tadao Nomura, Echizen (JP); Hiroaki Nagata, Echizen (JP); Takehisa Minowa, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 314 days.

(21) Appl. No.: 14/462,134

(22) Filed: Aug. 18, 2014

(65) Prior Publication Data

US 2015/0093501 A1 Apr. 2, 2015

Related U.S. Application Data

(62) Division of application No. 12/825,917, filed on Jun. 29, 2010, now Pat. No. 9,044,810.

(30) Foreign Application Priority Data

Jul. 1, 2009 (JP) ..... 2009-156644

(51) Int. Cl.
*H01F 41/02* (2006.01)
*B22F 7/06* (2006.01)
(Continued)

(52) U.S. Cl.
CPC ..... *B22F 7/062* (2013.01); *C22C 1/1094* (2013.01); *C22C 28/00* (2013.01); *C22C 38/005* (2013.01);
(Continued)

(58) Field of Classification Search
None
See application file for complete search history.

(56) References Cited

U.S. PATENT DOCUMENTS 4,496,395 A 1/1985 Croat
5,034,146 A 7/1991 Ohashi et al.
(Continued)

FOREIGN PATENT DOCUMENTS

CN 1327889 A 12/2001
CN 101707107 5/2010
(Continued)

OTHER PUBLICATIONS

Ando et al. (Elements of Rapid Solidification, 1998).*
(Continued)

*Primary Examiner* — Xiaowei Su
(74) *Attorney, Agent, or Firm* — Westman, Hattori, Daniels & Adrian, LLP

(57) ABSTRACT

A rare earth magnet is prepared by disposing a $R^1$-T-B sintered body comprising a $R^1{}_2T_{14}B$ compound as a major phase in contact with an $R^2$-M alloy powder and effecting heat treatment for causing $R^2$ element to diffuse into the sintered body. The alloy powder is obtained by quenching a melt containing $R^2$ and M. $R^1$ and $R^2$ are rare earth elements, T is Fe and/or Co, M is selected from B, C, P, Al, Si, Ti, V, Cr, Mn, Fe, Co, Ni, Cu, Zn, Ga, Ge, Zr, Nb, Mo, Ag, In, Sn, Sb, Hf, Ta, W, Pt, Au, Pb, and Bi.

7 Claims, 2 Drawing Sheets

(51) Int. Cl.

| | |
|---|---|
| ***C22C 1/10*** | (2006.01) |
| ***C22C 28/00*** | (2006.01) |
| ***C22C 38/00*** | (2006.01) |
| ***C22C 45/00*** | (2006.01) |
| ***H01F 1/057*** | (2006.01) |
| ***H01F 1/153*** | (2006.01) |

(52) U.S. Cl.

CPC ..... *C22C 45/00* (2013.01); *H01F 1/0577* (2013.01); *H01F 1/15333* (2013.01); *H01F 41/0293* (2013.01); *B22F 2998/10* (2013.01); *B22F 2999/00* (2013.01)

(56) References Cited

U.S. PATENT DOCUMENTS

| | | | | |
|---|---|---|---|---|
| 5,405,455 | A | 4/1995 | Kusunoki et al. | |
| 7,048,808 | B2 | 5/2006 | Kaneko et al. | |
| 7,402,226 | B2 | 7/2008 | Machida et al. | |
| 7,824,506 | B2 | 11/2010 | Machida et al. | |
| 7,985,303 | B2 | 7/2011 | Nagata et al. | |
| 8,025,744 | B2 | 9/2011 | Nagata et al. | |
| 8,252,123 | B2 | 8/2012 | Nagata et al. | |
| 8,277,578 | B2 | 10/2012 | Nagata et al. | |
| 8,557,057 | B2 * | 10/2013 | Nagata | H01F 1/0577 148/101 |
| 9,044,810 | B2 * | 6/2015 | Nomura | B22F 7/062 |
| 2002/0038680 | A1 | 4/2002 | Arai et al. | |
| 2002/0053372 | A1 | 5/2002 | Arai et al. | |
| 2002/0153064 | A1 * | 10/2002 | Arai | B82Y 25/00 148/301 |
| 2004/0050454 | A1 * | 3/2004 | Sekino | H01F 1/058 148/105 |
| 2006/0231163 | A1 | 10/2006 | Hirosawa et al. | |
| 2007/0034299 | A1 | 2/2007 | Machida et al. | |
| 2007/0131309 | A1 | 6/2007 | Shigemoto et al. | |
| 2007/0240789 | A1 * | 10/2007 | Nakamura | H01F 41/0293 148/101 |
| 2008/0006345 | A1 | 1/2008 | Machida et al. | |
| 2008/0223489 | A1 | 9/2008 | Nagata et al. | |
| 2008/0245442 | A1 | 10/2008 | Nakamura et al. | |
| 2008/0286595 | A1 | 11/2008 | Yoshimura et al. | |
| 2009/0098006 | A1 | 4/2009 | Nakamura et al. | |
| 2009/0127494 | A1 | 5/2009 | Kanekiyo et al. | |
| 2009/0223606 | A1 * | 9/2009 | Kanekiyo | B22D 11/0611 148/538 |
| 2009/0226339 | A1 | 9/2009 | Nakamura et al. | |
| 2009/0252865 | A1 | 10/2009 | Sagawa | |
| 2009/0297699 | A1 | 12/2009 | Baba et al. | |
| 2010/0119703 | A1 | 5/2010 | Sagawa | |
| 2010/0164663 | A1 | 7/2010 | Nagata et al. | |
| 2011/0036457 | A1 | 2/2011 | Nagata et al. | |
| 2011/0036458 | A1 | 2/2011 | Nagata et al. | |
| 2011/0090032 | A1 | 4/2011 | Nagata et al. | |
| 2011/0150691 | A1 | 6/2011 | Nakamura et al. | |
| 2012/0280775 | A1 * | 11/2012 | Nagata | H01F 41/0293 335/302 |

FOREIGN PATENT DOCUMENTS

| | | | | |
|---|---|---|---|---|
| EP | 0 425 469 | A2 | 5/1991 | |
| EP | 1 845 539 | A2 | 10/2007 | |
| EP | 1845539 | A2 | 10/2007 | |
| EP | 1 879 201 | A1 | 1/2008 | |
| EP | 1970924 | A1 | 9/2008 | |
| EP | 2071597 | A1 | 6/2009 | |
| EP | 2 144 257 | A1 | 1/2010 | |
| JP | 62-74048 | A | 4/1987 | |
| JP | 1-117303 | A | 5/1989 | |
| JP | 5-21218 | A | 1/1993 | |
| JP | 5-31807 | B2 | 5/1993 | |
| JP | 3143156 | B2 | 3/2001 | |
| JP | 2002-059246 | A | 2/2002 | |
| JP | 2002-190404 | A | 7/2002 | |
| JP | 2003-293008 | A | 10/2003 | |
| JP | 2004-296973 | A | 10/2004 | |
| JP | 2004-304038 | A | 10/2004 | |
| JP | 2005-11973 | A | 1/2005 | |
| JP | 3897724 | B2 | 3/2007 | |
| JP | 2007-284738 | A | 11/2007 | |
| JP | 2007-287874 | A | 11/2007 | |
| JP | 2008-235343 | A | 10/2008 | |
| JP | 2008-263179 | A | 10/2008 | |
| JP | 2009-289994 | A | 12/2009 | |
| JP | 2010-98115 | A | 4/2010 | |
| JP | 4450239 | B2 | 4/2010 | |
| JP | 4482769 | B2 | 6/2010 | |
| JP | 4548673 | B2 | 9/2010 | |
| JP | 2010-238712 | A | 10/2010 | |
| JP | 4656323 | B2 | 3/2011 | |
| TW | 200905699 | A | 2/2009 | |
| WO | 2006-043348 | A1 | 4/2006 | |
| WO | 2006/064848 | A1 | 6/2006 | |
| WO | WO 2006064794 | A1 * | 6/2006 | B22D 11/0611 |
| WO | 2007/102391 | A1 | 9/2007 | |
| WO | 2008/023731 | A1 | 2/2008 | |
| WO | 2008/0032426 | A1 | 3/2008 | |
| WO | 2008/139690 | A1 | 11/2008 | |

OTHER PUBLICATIONS

English Translation of Taiwanese Office Action dated May 12, 2014, issued in corresponding Taiwanese Patent Application No. 099121499. (6 pages).

Japanese Office Action dated Nov. 16, 2011, issued in corresponding Japanese Patent Application No. 2009-156644.

European Search Report dated Aug. 18, 2010, issued in corresponding European Patent Application No. 10251177.1.

Machida, K. et al, "High-Performance Rare Earth Magnet Having Specific Element Segregated at Grain Boundaries", Metal (Kinzoku), Aug. 2008, p. 760-765, vol. 78 No. 8.

Park, K.T. et al., "Effect of Metal-Coating and Consecutive Heat Treatment on Coercivity of Thin Nd—Fe—B Sintered Magnets", Proceedings of the Sixteenth International Workshop on Rare-Earth Magnets and Their Applications, The Japan Institute of Metals, Sep. 2000, p. 257-264.

Taiwanese Office Action dated May 12, 2014, issued in corresponding Taiwanese Patent Application No. 099121499 (6 pages).

Durst, K. D., et al., "The Coercive Field of Sintered and Melt-Spun NdFeB Magnets", Journal of Magnetism and Magnetic materials, 1987, vol. 68, p. 63-75. (7 pages).

Office Action dated May 12, 2015, issued in Japanese Patent Application No. 2012-094453 which is counterpart to U.S. Appl. No. 13/461,043, w/machine translation. (4 pages).

Machida, Kenichi et al., "Grain Boundary Modification and MAgnetic Properties of Nd—Fe—B Sintered Magnets", Abstracts of Spring Meeting of Japan Society of Powder and Powder Metallurgy, 2004, p. 202, w/ English translation. (7 pages).

Extended European Search Report dated Sep. 19, 2012, issued in European patent application 12166397.5. which is counterpart to U.S. Appl. No. 13/461,043. (6 pages).

Non-Final Office Action dated Jul. 24, 2015, issued in U.S. Appl. No. 13/461,043. (20 pages).

Final Office Action dated Feb. 8, 2016, issued in U.S. Appl. No. 13/461,043. (9 pages).

Non-Final Office Action dated Sep. 9, 2016, issued in U.S. Appl. No. 13/461,043. (22 pages).

* cited by examiner

RARE EARTH MAGNET AND ITS PREPARATION

CROSS-REFERENCE TO RELATED APPLICATION

This non-provisional application is a divisional of U.S. patent application Ser. No. 12/825,917, filed Jun. 29, 2010, which claims priority under 35 U.S.C. § 119(a) on Patent Application No. 2009-156644 filed in Japan on Jul. 1, 2009, the entire contents of which are hereby incorporated by reference.

TECHNICAL FIELD

This invention relates to a method for preparing a rare earth magnet using a quenched alloy powder containing rare earth and a rare earth magnet which is increased in coercive force while minimizing a decline of remanence.

BACKGROUND ART

Over the years, Nd—Fe—B sintered magnets find an ever increasing range of application including electric appliances, industrial equipment, electric vehicles and wind power plants. It is required to further improve the performance of Nd—Fe—B magnets.

A variety of approaches were taken for improving properties of Nd—Fe—B sintered magnets. Approaches for improving coercive force include refinement of grains, addition of Al, Ga or similar elements, and increase in the volume fraction of Nd-rich phase. The currently most common approach is substitution of Dy or Tb for part of Nd.

It is believed that the coercivity creating mechanism of Nd—Fe—B magnets is the nucleation type wherein nucleation of reverse magnetic domains at grain boundaries of $R_2Fe_{14}B$ major phase governs a coercive force. Substituting Dy or Tb for some Nd increases the anisotropic magnetic field of the $R_2Fe_{14}B$ phase to prevent nucleation of reverse magnetic domains whereby the coercive force is increased. When Dy or Tb is added in an ordinary way, however, a loss of remanence (or residual magnetic flux density) is unavoidable because Dy or Tb substitution occurs not only near the interface of major phase grains, but even in the interior of the grains. Another problem is an increased amount of expensive Tb and Dy used.

Also developed was a two-alloy method of preparing an Nd—Fe—B magnet by mixing two powdered alloys of different composition and sintering the mixture.

Specifically, a powder of alloy composed mainly of $R_2Fe_{14}B$ phase wherein R is Nd and Pr is mixed with a powder of R-rich alloy containing Dy or Tb. This is followed by fine pulverization, compaction in a magnetic field, sintering, and aging treatment whereby the Nd—Fe—B magnet is prepared (see JP-B H05-031807 and JP-A H05-021218). The sintered magnet thus obtained produces a high coercive force while minimizing a decline of remanence because Dy or Tb substitutes only near the grain boundary having a substantial impact on coercive force, and Nd or Pr in the grain interior is kept intact. In this method, however, Dy or Tb diffuses into the interior of major phase grains during the sintering so that the layer where Dy or Tb is segregated near grain boundaries has a thickness equal to or more than about 1 micrometer, which is substantially greater than the depth where nucleation of reverse magnetic domains occurs. The results are still unsatisfactory.

Recently, there were developed several processes of diffusing rare earth elements from the surface to the interior of a mother R—Fe—B sintered body. In one exemplary process, a rare earth metal such as Yb, Dy, Pr or Tb, or Al or Ta is deposited on the surface of Nd—Fe—B magnet using an evaporation or sputtering technique, followed by heat treatment. See JP-A S62-074048, JP-A H01-117303, JP-A 2004-296973, JP-A 2004-304038, JP-A 2005-011973; K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 257 (2000); and K. Machida and T. Lie, "High-Performance Rare Earth Magnet Having Specific Element Segregated at Grain Boundaries," Metal, 78, 760 (2008). In addition, diffusion of Dy from the surface of a sintered body in Dy vapor atmosphere is described in WO 2007/102391 and WO 2008/023731. A process involving coating a powder of rare earth inorganic compound such as fluoride or oxide onto the surface of a sintered body and heat treatment is described in WO 2006/043348. Diffusion of rare earth is effected while rare earth fluoride or oxide is chemically reduced with a $CaH_2$ reducing agent as disclosed in WO 2006/064848. Use of rare earth-containing intermetallic compound powder is disclosed in JP-A 2008-263179.

With these processes, the elements (e.g., Dy and Tb) disposed on the surface of the mother sintered body travel mainly along grain boundaries in the sintered body structure and diffuse into the interior of the mother sintered body during the heat treatment. If heat treatment conditions are optimized, there is obtained a structure in which the lattice diffusion into the major phase grain interior is restrained, and Dy and Tb are enriched in a very high concentration only at grain boundaries or near grain boundaries within sintered body major phase grains. As compared with the two-alloy method described previously, this structure provides an ideal morphology. Since the magnetic properties reflect the morphology, the magnet produces a minimized decline of remanence and an increased coercive force, accomplishing a drastic improvement in magnet performance.

However, the processes utilizing evaporation or sputtering (described in JP-A S62-074048, JP-A H01-117303, JP-A 2004-296973, JP-A 2004-304038, JP-A 2005-011973, WO 2007/102391, WO 2008/023731, and the article of Park, et al.) are problematic in mass production because treatment of a large amount of material at a time is difficult and magnet properties vary over a wide range. The process also suffers from a substantial loss of Dy since most of Dy evaporating from the source scatters in the chamber.

The process described in WO 2006/064848 relies on the chemical reduction of rare earth fluorides or oxides with a $CaH_2$ reducing agent. It is also unamenable to mass production because $CaH_2$ is readily reactive with moisture and hazardous to handle.

In the process of JP-A 2008-263179, a sintered body is coated with a powder composed mainly of an intermetallic compound phase consisting of a rare earth element such as Dy or Tb and an element M which is selected from Al, Si, C, P, Ti, V, Cr, Mn, Ni, Cu, Zn, Ga, Ge, Zr, Nb, Mo, Ag, In, Sn, Sb, Hf, Ta, W, Pb, and Bi and mixtures thereof, followed by heat treatment. The process has the advantage of easy handling because the intermetallic compound is hard and brittle and thus easy to pulverize, and less susceptible to oxidation or reaction even when dispersed in liquids such as water and alcohols. However, the intermetallic compound is not completely unsusceptible to oxidation or reaction. If deviated from the desired composition, some reactive phases other than the intermetallic compound phase may form, which are prone to ignition and combustion.

CITATION LIST

Patent Document 1: JP-B H05-031807
Patent Document 2: JP-A H05-021218
Patent Document 3: JP-A S62-074048
Patent Document 4: JP-A H01-117303
Patent Document 5: JP-A 2004-296973
Patent Document 6: JP-A 2004-304038
Patent Document 7: JP-A 2005-011973
Patent Document 8: WO 2007/102391
Patent Document 9: WO 2008/023731
Patent Document 10: WO 2006/043348
Patent Document 11: WO 2006/064848
Patent Document 12: JP-A 2008-263179
Non-Patent Document 1: K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 257 (2000)
Non-Patent Document 2: K. Machida and T. Lie, "High-Performance Rare Earth Magnet Having Specific Element Segregated at Grain Boundaries," Metal, 78, 760 (2008)

DISCLOSURE OF INVENTION

An object of the invention is to provide a sintered R-T-B rare earth permanent magnet which is increased in coercive force while minimizing a decline of remanence, and a method for efficiently preparing the R-T-B rare earth permanent magnet in a consistent manner.

The inventors have found that if heat treatment is effected on a R—Fe—B sintered body with a diffusing material in contact with the surface thereof, the diffusing material being a quenched alloy powder obtained by quenching a melt containing $R^2$ and M wherein $R^2$ is one or more element selected from rare earth elements including Sc and Y and M is one or more element selected from the group consisting of B, C, P, Al, Si, Ti, V, Cr, Mn, Fe, Co, Ni, Cu, Zn, Ga, Ge, Zr, Nb, Mo, Ag, In, Sn, Sb, Hf, Ta, W, Pt, Au, Pb, and Bi, then an R—Fe—B magnet having excellent properties is prepared by a highly productive method because the alloy powder is unsusceptible to oxidation and the hazard of handling is thus reduced.

In one aspect, the invention provides a method for preparing a rare earth magnet comprising the steps of:

providing a $R^1$-T-B sintered body comprising a $R^1{}_2T_{14}B$ compound as a major phase wherein $R^1$ is one or more element selected from rare earth elements including Sc and Y and T is Fe and/or Co, providing a powder of an alloy containing $R^2$ and M wherein $R^2$ is one or more element selected from rare earth elements including Sc and Y and M is one or more element selected from the group consisting of B, C, P, Al, Si, Ti, V, Cr, Mn, Fe, Co, Ni, Cu, Zn, Ga, Ge, Zr, Nb, Mo, Ag, In, Sn, Sb, Hf, Ta, W, Pt, Au, Pb, and Bi, applying the alloy powder onto the surface of the sintered body, and heating the sintered body and the alloy powder in vacuum or an inert gas atmosphere at a temperature equal to or lower than the sintering temperature of the sintered body for causing $R^2$ element to diffuse into the sintered body, wherein the alloy powder is a quenched alloy powder obtained by quenching a melt containing $R^2$ and M.

In a preferred embodiment, the quenched alloy powder comprises microcrystals of a $R^2$-M intermetallic compound phase or an amorphous alloy.

In another aspect, the invention provides a rare earth magnet obtained by heat treatment of a $R^1$-T-B sintered body having a quenched alloy powder disposed on its surface, the quenched alloy containing $R^2$ and M, wherein $R^1$ is one or more element selected from rare earth elements including Sc and Y, T is Fe and/or Co, $R^2$ is one or more element selected from rare earth elements including Sc and Y, and M is one or more element selected from the group consisting of B, C, P, Al, Si, Ti, V, Cr, Mn, Fe, Co, Ni, Cu, Zn, Ga, Ge, Zr, Nb, Mo, Ag, In, Sn, Sb, Hf, Ta, W, Pt, Au, Pb, and Bi, wherein at least one element of $R^2$ and M is segregated near grain boundaries and/or surfaces of $R^1{}_2T_{14}B$ compound grains in the sintered body.

Advantageous Effects of Invention

According to the invention, a high-performance R-T-B sintered magnet is prepared by coating a quenched alloy powder containing $R^2$ and M onto a sintered body and effecting diffusion treatment. The advantages of the magnet include inhibited oxidation of the powder, a minimal hazard of handling, efficient productivity, reduced amounts of expensive Tb and Dy used, an increased coercive force, and a minimized decline of remanence.

DESCRIPTION OF EMBODIMENTS

Figure 1:
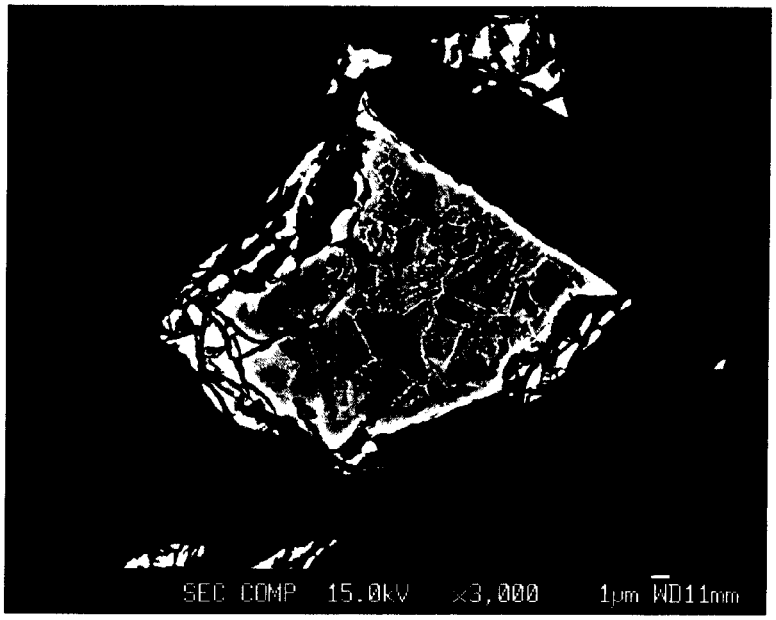
FIG. 1 is a back-scattering electron image in cross section of a particle in Example 1.

Briefly stated, a R-T-B sintered magnet is prepared according to the invention by coating a quenched alloy powder containing $R^2$ and M onto a sintered body and effecting diffusion treatment.

The mother material used herein is a sintered body of the composition $R^1$-T-B, which is often referred to as "mother sintered body." Herein $R^1$ is one or more element selected from rare earth elements inclusive of scandium (Sc) and yttrium (Y), specifically from among Sc, Y, La, Ce, Pr, Nd, Sm, Eu, Gd, Tb, Dy, Ho, Er, Yb, and Lu. Preferably the majority of $R^1$ is Nd and/or Pr. Preferably the rare earth elements inclusive of Sc and Y account for 12 to 20 atomic percents (at %), and more preferably 14 to 18 at % of the entire sintered body. T is one or more element selected from iron (Fe) and cobalt (Co) and preferably accounts for 72 to 84 at %, and more preferably 75.5 to 81 at % of the entire sintered body. If necessary, T may be replaced in part by one or more element selected from Al, Si, Ti, V, Cr, Mn, Ni, Cu, Zn, Ga, Ge, Zr, Nb, Mo, Ag, In, Sn, Sb, Hf, Ta, W, Pt, Au, Pb, and Bi. The replacement amount is preferably up to 10 at % of the entire sintered body to avoid any drop of magnetic properties. B is boron, and preferably accounts for 4 to 8 at % of the entire sintered body. Particularly when B is 5 to 6.5 at %, a significant improvement in coercive force is achieved by diffusion treatment.

The alloy for the mother sintered body is prepared by melting metal or alloy feeds in vacuum or an inert gas atmosphere, preferably argon atmosphere, and casting the melt into a flat mold or book mold or strip casting. If primary crystal α-Fe is left behind, the cast alloy may be subjected to homogenizing treatment at 700 to 1,200° C. for at least one hour in vacuum or in an Ar atmosphere. Also applicable to the preparation of the mother sintered body is a so-called two-alloy process involving separately preparing an alloy approximate to the $R_2Fe_{14}B$ compound composition constituting the major phase of the relevant alloy and a rare earth-rich alloy serving as a sintering aid, crushing, then weighing and mixing them.

The alloy is first crushed or coarsely ground to a size of about 0.05 to 3 mm. The crushing step generally uses a Brown mill or hydriding pulverization. The coarse powder is then finely divided on a jet mill or ball mill. On use of a jet mill using high-pressure nitrogen, for example, the alloy is generally milled into a fine particle powder having an average particle size of 0.5 to 20 μm, more preferably 1 to 10 μm. The fine powder is compacted with their axes of easy magnetization aligned under an external magnetic field. The green compact is then placed in a sintering furnace where it is sintered in vacuum or in an inert gas atmosphere usually at a temperature of 900 to 1,250° C., preferably 1,000 to 1,100° C. The sintered block may be further heat treated, if necessary. To inhibit oxidation, all or some of the series of steps may be conducted in an oxygen-depleted atmosphere. The sintered block may then be machined or worked into a predetermined shape, if necessary.

The sintered block contains 60 to 99% by volume, preferably 80 to 98% by volume of the tetragonal $R_2T_{14}B$ compound (herein, $R^1{}_2T_{14}B$ compound) as the major phase, with the balance being 0.5 to 20% by volume of a rare earth-rich phase and 0.1 to 10% by volume of at least one compound selected from among rare earth oxides, and rare earth carbides, nitrides and hydroxides derived from incidental impurities, and mixtures or composites thereof.

Separately a powder material to be coated onto and diffused into the mother sintered body is prepared. The invention is characterized in that a powder of a quenched alloy containing $R^2$ and M is used as the material to be coated. Herein, $R^2$ is one or more element selected from rare earth elements including Sc and Y, specifically from the group consisting of Sc, Y, La, Ce, Pr, Nd, Sm, Eu, Gd, Tb, Dy, Ho, Er, Yb, and Lu. Preferably the majority of $R^2$ is one or more element selected from Nd, Pr, Tb, and Dy. M is one or more element selected from the group consisting of B, C, P, Al, Si, Ti, V, Cr, Mn, Fe, Co, Ni, Cu, Zn, Ga, Ge, Zr, Nb, Mo, Ag, In, Sn, Sb, Hf, Ta, W, Pt, Au, Pb, and Bi.

If the alloy to be coated is a single metal or eutectic alloy, a powder suited for coating is not available because of difficulty of pulverization. When an alloy ingot composed mainly of an intermetallic compound phase is used as the raw material, its powder is suited for coating because the intermetallic compound is generally easy to pulverize due to hard and brittle nature and unsusceptible to oxidation due to a high chemical stability. However, a distinct phase may form as the primary crystal. Also a reactive rare earth-rich phase may locally segregate other than the desired intermetallic compound phase because of a relatively limited freedom of composition. If so, the material in powder form is susceptible to oxidation or reaction, leaving the risk of ignition and combustion.

In contrast, the quenched alloy powder used herein has a fine uniform structure and a higher chemical stability. Because of a least likelihood of segregation of a reactive phase, reaction with solvents is substantially inhibited, and the hazard in handling is substantially reduced. The quenched alloy powder also has the advantage of high freedom of choice of composition because the alloy can be prepared in a wide range of $R^2$/M ratio.

The quenched alloy powder may be prepared by any techniques such as single roll quenching, twin roll quenching, centrifugal quenching, and gas atomizing. Inter alia, the single roll quenching technique is easy to prepare the quenched alloy powder because of efficient cooling of a melt and easy adjustment of a cooling rate in terms of a roll circumferential speed.

With the single roll technique, the quenched alloy powder is prepared by melting metal or alloy feeds in vacuum or in an inert gas atmosphere, preferably argon atmosphere, and injecting the alloy melt against a single roll rotating at a high speed, yielding a ribbon of quenched alloy. The roll circumferential speed is preferably in a range of about 5 to 50 m/sec, more preferably 10 to 40 m/sec although the circumferential speed depends on a particular combination and composition of $R^2$ and M elements.

The quenched alloy ribbon thus obtained is then pulverized by any well-known pulverizing means such as a ball mill, jet mill, stamp mill and disk mill, into a quenched alloy powder having an average particle size of 0.1 to 100 μm. Hydriding pulverization may also be used. If the average particle size is less than 0.1 μm, even the quenched alloy powder cannot help abruptly oxidizing, with an increased risk of reaction. If particles are coarser than 100 μm, it is sometimes difficult to fully disperse the powder in organic solvents such as alcohols and water, failing to provide a coating weight sufficient for property improvement.

More preferably the quenched alloy powder has an average particle size of 0.5 to 50 lam, and even more preferably 1 to 20 μm. As used herein, the "average particle size" may be determined as a weight average diameter $D_{50}$ (particle diameter at 50% by weight cumulative, or median diameter) using, for example, a particle size distribution measuring instrument relying on laser diffractometry or the like.

The microstructure of the quenched alloy powder includes an amorphous alloy and/or a microcrystalline alloy. To form an amorphous alloy, an $R^2$-M alloy composition approaching the eutectic point in the equilibrium state is selected, from which a quenched alloy ribbon is prepared. For example, the eutectic point is found at Dy-20 at % Al in a Dy—Al system, Dy-30 at % Cu in a Dy—Cu system, and Tb-37.5 at % Co in a Tb—Co system. In an $R^2$-M system wherein M is a 3d transition element such as Fe, Co, Ni or Cu, or Al, Ga or the like, a relatively $R^2$-rich composition containing 60 to 95 at % of $R^2$ tends to be amorphous. Also boron, carbon or silicon may be added as the element for promoting the alloy to be amorphous. The amorphous alloy powder has a high chemical stability and corrosion resistance.

On the other hand, the microcrystal-containing alloy powder is composed mainly of microcrystals of $R^2$-M intermetallic compound phase. The microcrystalline structure may be obtained by selecting an alloy composition approaching the $R^2$-M intermetallic compound phase in the equilibrium state and forming a quenched alloy ribbon therefrom. Microcrystals preferably have an average grain size of up to 3 μm, more preferably 1 μm. The microcrystalline alloy thus prepared has a structure which is substantially homogeneous in a macroscopic view, with a little likelihood that a distinct phase other than the compound locally coarsens. Even when a distinct phase arises from a compositional shift, it is formed as an extremely thin phase at the boundary between microcrystals, with the minimized likelihood of abrupt reaction and the reduced risk of ignition and combustion. The alloy consisting of microcrystals is easier to pulverize than the amorphous alloy. In the case of microcrystal-based alloy powder, the volume fraction of major phase microcrystals is preferably at least 70%, more preferably at least 90%. With respect to the "volume fraction" as used herein, an area fraction computed from a back-scattering electron image in cross section of particles may be directly considered as the volume fraction. A structure form encompassing both an $R^2$-M intermetallic compound phase and an amorphous phase is also acceptable.

The quenched alloy powder is then disposed on the surface of the mother sintered body prepared as above. The quenched alloy powder in contact with the mother sintered body is heat treated in vacuum or in an atmosphere of an inert gas such as argon (Ar) or helium (He) at a temperature equal to or below the sintering temperature (designated Ts in ° C.) of the sintered body. The quenched alloy powder is disposed in contact with the surface of the mother sintered body, for example, by dispersing the powder in water or an organic solvent (e.g., alcohol) to form a slurry, immersing the sintered body in the slurry, and drying the immersed sintered body by air drying, hot air drying or in vacuum. Use of a viscosity-modified solvent is also effective for controlling a coating weight. Spray coating is also possible.

The conditions of heat treatment vary with the type and composition of the quenched alloy powder and are preferably selected such that $R^2$ and/or M is enriched near grain boundaries in the interior of the sintered body and/or grain boundaries within sintered body major phase grains. The heat treatment temperature is equal to or below the sintering temperature (Ts) of the mother sintered body. If heat treatment is effected above Ts, a problem may arise that the structure of the sintered body can be altered to degrade magnetic properties, and thermal deformation may occur. For this reason, the heat treatment temperature is lower than Ts (° C.) of the mother sintered body by at least 100° C. The lower limit of heat treatment temperature is typically at least 300° C., and preferably at least 500° C. in order to provide the desirable diffused structure.

The time of heat treatment is typically from 1 minute to 50 hours. Within less than 1 minute, the diffusion treatment is not complete. If the treatment time is over 50 hours, the structure of the sintered body can be altered, oxidation or evaporation of components inevitably occurs to degrade magnetic properties, or $R^2$ or M is not only enriched near grain boundaries in the sintered body and/or grain boundaries within major phase grains, but also diffuses into the interior of major phase grains. The preferred time of heat treatment is from 10 minutes to 30 hours, and more preferably from 30 minutes to 20 hours.

Through appropriate heat treatment, the constituent element $R^2$ and/or M of the quenched alloy powder coated on the surface of the mother sintered body is diffused into the sintered body while traveling mainly along grain boundaries in the sintered body structure. This results in the structure in which $R^2$ and/or M is enriched or segregated near grain boundaries in the interior of the sintered body and/or grain boundaries within sintered body major phase (specifically $R^1{}_2T_{14}B$ compound phase) grains (or near surfaces of grains).

Some microcrystal-based quenched alloy powders have a melting point which is higher than the diffusion heat treatment temperature. Even in such a case, the heat treatment causes $R^2$ and M elements to diffuse fully into the sintered body. It is believed that diffusion occurs because constituents of the alloy powder coated are carried into the sintered body while reacting with the R-rich phase on the sintered body surface.

In the R—Fe—B magnet thus obtained, $R^2$ and M elements are enriched near grain boundaries in the sintered body or grain boundaries within the sintered body major phase grains, but lattice diffusion into the interior of major phase grains is restricted. This results in a small decline of remanence before and after the diffusion heat treatment. On the other hand, the diffusion of $R^2$ improves the magnetocrystalline anisotropy near major phase grain boundaries, leading to a substantial improvement in coercive force. A high performance permanent magnet is obtained. The simultaneous diffusion of M element promotes diffusion of $R^2$ and forms a M-containing phase at grain boundaries, also contributing to an improvement in coercive force.

After the diffusion heat treatment, the magnet may be further subjected to heat treatment at a temperature of 200 to 900° C. for augmenting the coercivity enhancement.

EXAMPLE

Examples are given below for further illustrating the invention although the invention is not limited thereto.

Example 1 and Comparative Examples 1, 2

A magnet alloy was prepared by using Nd, Pr, Fe and Co metals having a purity of at least 99% by weight and ferroboron, high-frequency heating in an argon atmosphere for melting, and strip-casting the alloy melt. The alloy was subjected to hydriding pulverization into a coarse powder with a particle size of up to 1 mm. The coarse powder was finely pulverized on a jet mill into a fine powder having a mass median particle diameter of 4.6 μm. The fine powder was compacted under a pressure of about 100 MPa in a nitrogen atmosphere while being oriented in a magnetic field of 1.6 MA/m. The green compact was then placed in a vacuum sintering furnace where it was sintered at 1,060° C. for 3 hours, obtaining a sintered block. From the sintered block, a piece having dimensions of 4 4 2 mm was cut out as a mother sintered body. The sintered body had a composition consisting of, in atom percent, 13.2% of Nd, 1.2% of Pr, 2.5% of Co, 6.0% of B and the balance of Fe.

Next, an alloy ingot was prepared by using Dy and Al metals having a purity of at least 99% by weight as raw materials and arc melting them so that the alloy ingot might have a composition consisting of, in atom percent, 35% of Dy and the balance of Al. Separately, an alloy of the same composition was placed in a quartz tube having a nozzle opening of 0.5 mm where it was melted by high-frequency heating in an argon atmosphere and then injected against a copper chill roll rotating at a circumferential speed of 30 msec, obtaining a ribbon of quenched alloy. Further the quenched alloy ribbon or the alloy ingot was finely pulverized on a ball mill for 30 minutes. The powder resulting from the quenched alloy ribbon (Example 1) had a mass median diameter of 9.1 μm and the powder resulting from the alloy ingot (Comparative Example 1) had a mass median diameter of 8.8 μM.

The powder resulting from the quenched alloy ribbon or the powder resulting from the alloy ingot, 15 g, was mixed with 45 g of ethanol and agitated to form a slurry. The mother sintered body was immersed in the slurry, pulled up from the slurry and dried in hot air, completing coating of the powder to the surface of the mother sintered body. The powder-coated sintered bodies were subjected to diffusion treatment (heat treatment) in vacuum at 850° C. for 8 hours and further to aging treatment at 450° C., yielding magnets of Example 1 and Comparative Example 1. In the absence of a powder coating, the mother sintered body alone was subjected to similar heat treatment and aging treatment, yielding a magnet of Comparative Example 2. These magnet samples were measured for magnetic properties by a vibrating sample magnetometer (VSM). Table 1 summarizes the average powder coating weight and the magnetic properties (residual magnetization J and coercive force Hcj) after demagnetizing field correction.

On X-ray diffraction analysis, both the alloy powder and ingot powder used in Example 1 and Comparative Example 1, respectively, were identified to have a $DyAl_2$ phase as the major phase. From back-scattering electron images in cross section of particles by EPMA, the average volume fraction of the major phase in the powder was calculated to be 8.1% in the powder of Example 1 and 9.0% in the powder of Comparative Example 1. After each powder was immersed in deionized water for one week, an oxygen concentration was determined by ICP analysis, with the results shown in Table 1. A difference (ΔO) in oxygen concentration (mass ratio) before and after deionized water immersion was significantly smaller in the powder of Example 1 than in the powder of Comparative Example 1.

Figure 2:
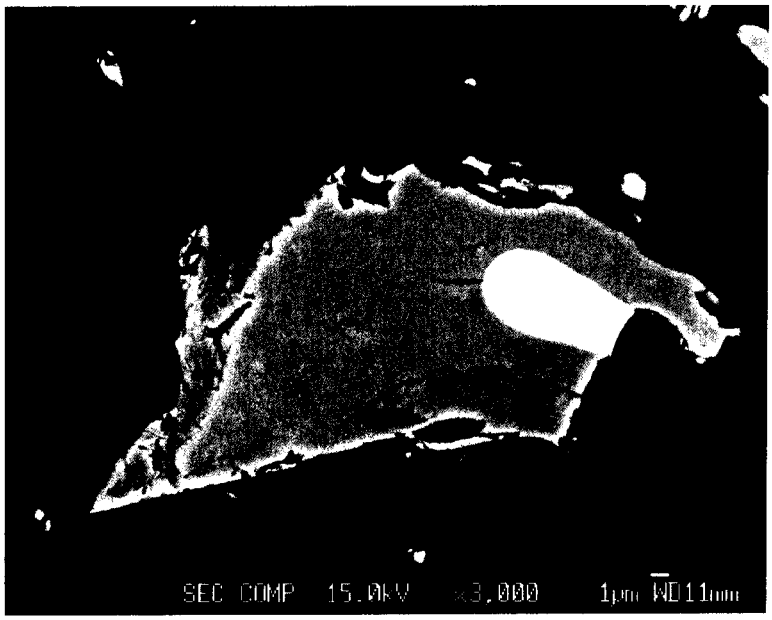
FIG. 2 is a back-scattering electron image in cross section of a particle in Comparative Example 1.

FIGS. 1 and 2 are back-scattering electron images in cross section of particles of Example 1 and Comparative Example 1, respectively. In the powder of Comparative Example 1 (FIG. 2) containing the major phase depicted as a gray zone, a distinct rare earth-rich phase depicted as a white zone was locally segregated. In the powder of Example 1 (FIG. 1), a distinct rare earth-rich phase depicted as a white zone was formed as a thin grain boundary phase around a fine major phase zone of 1 μm or less depicted as a gray zone.

Example 2

An alloy was prepared by using Dy and Al metals having a purity of at least 99% by weight as raw materials and arc melting them so that the alloy might have a composition consisting of, in atom percent, 80% of Dy and the balance of Al. It was processed as in Example 1 to form a quenched alloy ribbon, which was finely pulverized on a planetary ball mill for 3 hours. The quenched alloy powder had a mass median diameter of 26.2 μm. On X-ray diffraction analysis, it was identified to have an amorphous structure having no specific crystal peaks. As in Example 1, the mother sintered body was coated with the powder, followed by diffusion treatment and aging treatment. The average powder coating weight, magnetic properties of the resultant magnet, and a change of oxygen concentration in the diffusion alloy powder are also shown in Table 1.

TABLE 1

| | Average powder coating weight (μg/mm) | J (T) | Hcj (MA/m) | Change ΔO in oxygen concentration of powder before and after deionized water immersion (wt %) |
|---|---|---|---|---|
| Example 1 | 25.9 | 1.43 | 1.68 | 0.14 |
| Example 2 | 8.9 | 1.44 | 1.46 | 0.15 |
| Comparative Example 1 | 23.4 | 1.43 | 1.65 | 0.28 |
| Comparative Example 2 | — | 1.45 | 1.07 | — |

Examples 3, 4 and Comparative Examples 3, 4

A magnet alloy was prepared by using Nd, Fe and Co metals having a purity of at least 99% by weight and ferroboron, high-frequency melting, and strip-casting the alloy melt. As in Example 1, a sintered block was prepared from the alloy. From the sintered block, a mother sintered body having dimensions of 10 10 5 mm was cut out. The sintered body had a composition consisting of, in atom percent, 13.8% of Nd, 1.0% of Co, 5.8% of B and the balance of Fe.

Next, an alloy was prepared by using Tb, Co and Fe metals having a purity of at least 99% by weight as raw materials and high-frequency melting. As in Examples 1 and 2, the alloy was processed into a quenched alloy ribbon and then into a quenched alloy powder. The mother sintered body was coated with the powder, followed by diffusion treatment (heat treatment) at 900° C. for 10 hours and aging treatment at 450° C. (Examples 3, 4). Table 2 summarizes the composition and average particle size of the diffusion alloy powder, and the identity and volume fraction of the major phase. Table 3 summarizes the average powder coating weight, magnetic properties (residual magnetization J and coercive force Hcj) of the resultant magnet, and a change of oxygen concentration in the diffusion alloy powder.

The magnet of Comparative Example 3 was obtained as in Comparative Example 1 by preparing a powder of an alloy ingot from Tb, Co and Fe metals as raw materials and coating the mother sintered body with the powder, followed by heat treatment and aging treatment. In Comparative Example 4, only the mother sintered body was subjected to similar heat treatment and aging treatment.

TABLE 2

| | Powder source | Composition of diffusion alloy powder (at %) | Major phase | Volume Fraction of major phase in powder | Average particle size of powder (m) |
|---|---|---|---|---|---|
| Example 3 | quenched ribbon | $Tb_{35}Co_{30}Fe_{bal.}$ | $Tb(CoFe)_2$ | 90% | 11.5 |
| Example 4 | quenched ribbon | $Tb_{67}Co_{20}Fe_{bal.}$ | amorphous | 100% | 29.1 |
| Comparative Example 3 | ingot | $Tb_{35}Co_{30}Fe_{bal.}$ | $Tb(CoFe)_2$ | 84% | 10.2 |
| Comparative Example 4 | — | — | — | — | — |

TABLE 3

| | Average powder coating weight (μg/mm) | J (T) | Hcj (MA/m) | Change ΔO in oxygen concentration of powder before and after deionized water immersion (wt %) |
|---|---|---|---|---|
| Example 3 | 27.2 | 1.42 | 1.77 | 0.17 |
| Example 4 | 9.1 | 1.43 | 1.52 | 0.05 |
| Comparative Example 3 | 20.9 | 1.42 | 1.75 | 0.50 |
| Comparative Example 4 | — | 1.44 | 0.96 | — |

Example 5 and Comparative Example 5

A magnet alloy was prepared by using Nd, Dy and Fe metals having a purity of at least 99% by weight and ferroboron as raw materials, high-frequency melting, and strip-casting the alloy melt. As in Example 1, a sintered block was prepared from the alloy. From the sintered block, a mother sintered body having dimensions of 10 10 5 mm was cut out. The sintered body had a composition consisting of, in atom percent, 14.4% of Nd, 1.2% of Dy, 5.3% of B and the balance of Fe.

Next, an alloy consisting of 35% of Dy and the balance of Sn was prepared by using Dy and Sn metals having a purity of at least 99% by weight as raw materials and high-frequency melting. As in Example 1, the alloy was processed into a quenched alloy ribbon and then into a quenched alloy powder. On X-ray diffraction analysis, the alloy powder was identified to have a $DySn_2$ phase as the major phase. The mother sintered body was coated with the powder, followed by diffusion treatment at 750° C. for 20 hours. The resulting magnet had magnetic properties, specifically a residual magnetization J of 1.22 T and a coercive force Hcj of 2.05 MA/m.

In Comparative Example 5, the alloy ingot of the same composition as in Example 5 was pulverized on a ball mill for 30 minutes, but the powder thus obtained could no longer be processed because it was susceptible to ignition and combustion in air.

Examples 6 to 15, Comparative Example 6

As in Examples 1 and 2, quenched alloy powders were prepared from various quenched alloy ribbons. A mother sintered body having a composition consisting of, in atom percent, 14.0% of Nd, 1.0% of Co, 0.4% of Al, 6.4% of B, and the balance of Fe and dimensions of 8 8 4 mm was coated with each powder, followed by diffusion treatment (heat treatment) at 830° C. for 12 hours and aging treatment at 450° C. Table 4 summarizes the composition of the diffusion alloy powder, the identity and volume fraction of the major phase, and magnetic properties (residual magnetization J and coercive force Hcj) of the resultant magnet.

TABLE 4

| | Composition of diffusion alloy powder (at %) | Major phase | Volume faction of major phase in powder | J (T) | Hcj (MA/m) |
|---|---|---|---|---|---|
| Example 6 | $Nd_7Tb_{30}Ni_{38}Al_{20}Ga_5$ | $(NdTb)_1(NiAlGa)_2$ | 93% | 1.44 | 1.78 |
| Example 7 | $Gd_3Dy_{15}Co_{55}Ni_{25}Ta_1Mo_1$ | $(GdDy)_1(CoNi)_5$ | 87% | 1.44 | 1.54 |
| Example 8 | $Y_2La_5Pr_{42}Cu_{45}Bi_5Ti_1$ | $(YLaPr)_1(CuBi)_1$ | 91% | 1.45 | 1.06 |
| Example 9 | $Pr_{10}Dy_{30}Fe_{37}B_{20}Zr_3$ | amorphous | 100% | 1.44 | 1.47 |
| Example 10 | $Ce_3Pr_8Fe_{60}Co_{26}Zn_2Cr_1$ | $(CePr)_2(CoZnCr)_{17}$ | 84% | 1.45 | 0.96 |
| Example 11 | $Dy_{60}Si_{20}Al_8Ge_5In_5V_2$ | $Dy_5(SiAlGeIn)_3$ | 81% | 1.43 | 1.57 |
| Example 12 | $La_5Sm_1Ho_5Pr_{28}Mn_{40}Sb_4P_4C_{13}$ | amorphous | 100% | 1.45 | 0.98 |
| Example 13 | $Nd_2Pr_8Eu_1Tb_{15}Zn_{65}Co_6Au_1Pb_1Nb_1$ | $(NdPrEuTb)_1$ $(ZnCoAuPbNb)_3$ | 90% | 1.43 | 1.67 |
| Example 14 | $Nd_{30}Dy_{38}Sn_{27}In_3Pt_1Ti_1$ | $(NdDy)_2(SnInPt)_1$ | 85% | 1.43 | 1.43 |
| Example 15 | $Pr_{10}Nd_{10}Tb_{50}Cu_{20}Ni_7Al_3$ | amorphous | 100% | 1.44 | 1.70 |
| Comparative Example 6 | not coated | — | — | 1.45 | 0.91 |

Japanese Patent Application No. 2009-156644 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth magnet comprising:

providing a $R^1$-T-B sintered body comprising a $R^1{}_2T_{14}B$ compound as a major phase wherein $R^1$ is one or more element selected from rare earth elements including Sc and Y and T is Fe and/or Co, providing an alloy powder consisting of $R^2$ and M wherein $R^2$ is one or more element selected from rare earth elements including Sc and Y and M is one or more element selected from the group consisting of P, Al, Si, Ti, V, Cr, Mn, Fe, Co, Ni, Cu, Zn, Ga, Ge, Zr, Nb, Mo, Ag, In, Sn, Sb, Hf, Ta, W, Pt, Au, Pb, and Bi, wherein the alloy powder is a quenched alloy powder obtained by quenching a melt consisting of the $R^2$ and M, with a single roll at a circumferential speed of in a range of 5 to 50 m/sec to form a quenched alloy ribbon and pulverizing the quenched alloy ribbon, the quenched alloy powder has an average particle size of 1 to 20 μm and comprises microcrystals of a $R^2$-M intermetallic compound phase having an average grain size of up to 3 μm and an amorphous, and a volume fraction of the microcrystals of the $R^2$-M intermetallic compound phase having an average grain size of up to 3 μm in the alloy powder is at least 70%, applying the alloy powder onto a surface of the sintered body, and heating the sintered body and the alloy powder in vacuum or an inert gas atmosphere at a temperature equal to or lower than the sintering temperature of the sintered body for thereby causing $R^2$ element to diffuse into the sintered body.

2. The method of claim 1, wherein in the alloy powder, a majority of the $R^2$ by atomic % at least one selected from the group consisting of Nd, Pr, Tb and Dy.

3. The method of claim 1, wherein the $R^2$ and M is enriched at grain boundaries in the interior of the sintered body.

4. The method of claim 1, wherein the $R^2$ and M is at a grain surface of the major phase.

5. The method of claim 1, wherein the microcrystals of the $R^2$-M intermetallic compound phase have an average grain size of up to 1 μm.

6. The method of claim 1, wherein the volume fraction of the microcrystals is at least 90%.

7. The method of claim 1, wherein the circumferential speed is in a range of 10 to 40 m/sec.

* * * * *